US009896977B2

(12) United States Patent
Suzuki

(10) Patent No.: US 9,896,977 B2
(45) Date of Patent: Feb. 20, 2018

(54) VALVE TIMING CONTROL APPARATUS AND MANUFACTURING METHOD THEREOF

(71) Applicant: DENSO CORPORATION, Kariya, Aichi-pref. (JP)

(72) Inventor: Tomonori Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 77 days.

(21) Appl. No.: 15/198,224

(22) Filed: Jun. 30, 2016

(65) Prior Publication Data

US 2017/0051640 A1 Feb. 23, 2017

(30) Foreign Application Priority Data

Aug. 21, 2015 (JP) ..... 2015-163925

(51) Int. Cl.
*F01L 1/46* (2006.01)
*F01L 1/344* (2006.01)
*F01L 1/02* (2006.01)

(52) U.S. Cl.
CPC ..... *F01L 1/3442* (2013.01); *F01L 1/022* (2013.01); *F01L 1/46* (2013.01); *F01L 2001/34483* (2013.01); *F01L 2103/00* (2013.01)

(58) Field of Classification Search
CPC .. F01L 1/3442; F01L 2001/34483; F01L 1/46
USPC ..... 123/90.15, 90.65, 90.67
See application file for complete search history.

(56) References Cited

U.S. PATENT DOCUMENTS

2002/0121254 A1* 9/2002 Yamauchi ..... F01L 1/3442 123/90.17
2005/0115528 A1* 6/2005 Imaizumi ..... F01L 1/022 123/90.17
2014/0338619 A1* 11/2014 Nakamura ..... F01L 1/3442 123/90.15

* cited by examiner

*Primary Examiner* — Jorge Leon, Jr.
(74) *Attorney, Agent, or Firm* — Nixon & Vanderhye P.C.

(57) ABSTRACT

A sprocket plate, which is rotated synchronously with a crankshaft, includes a tapered hole portion. A shoe housing, which stops rotation of an inner rotor, includes a press fitting hole portion, which extends straight and into which a positioning member is press fitted. The positioning member includes: a contacting distal end portion that is inserted into the tapered hole portion in an axial direction and contacts an inner peripheral surface of the tapered hole portion at a specific side; a main shaft portion that extends straight in the axial direction and is press fitted into the press fitting hole portion in the axial direction; and a loosely inserting shaft portion that is formed between the contacting distal end portion and the main shaft portion and is loosely inserted into the press fitting hole portion in the axial direction.

14 Claims, 13 Drawing Sheets

VALVE TIMING CONTROL APPARATUS AND MANUFACTURING METHOD THEREOF

CROSS REFERENCE TO RELATED APPLICATION

This application is based on and incorporates herein by reference Japanese Patent Application No. 2015-163925 filed on Aug. 21, 2015.

TECHNICAL FIELD

The present disclosure relates to a valve timing control apparatus, which adjusts valve timing of a subject valve that is opened and closed by a camshaft through transmission of a crank torque from a crankshaft at an internal combustion engine, and a manufacturing method of such a valve timing control apparatus.

BACKGROUND

In a previously known valve timing control apparatus, an inner rotor, which is rotated in a circumferential direction synchronously with the camshaft, is rotated relative to an outer rotor, which is rotated in the circumferential direction synchronously with the crankshaft, so that the valve timing is adjusted in response to rotational phase between the inner rotor and the outer rotor.

For instance, JP2005-155346A (corresponding to US2005/0115528A1) discloses one such a valve timing control apparatus that has the outer rotor, which includes a synchronously rotatable member, a stopper member and a positioning member. Specifically, the synchronously rotatable member is rotated synchronously with the crankshaft when the synchronously rotatable member receives the crank torque. The stopper member is joined to the synchronously rotatable member in the axial direction and is thereby rotated synchronously with the synchronously rotatable member. The stopper member stops rotation of the inner rotor that is rotated relative to the stopper member in the circumferential direction. The positioning member is shaped into a rod form and extends in the axial direction. The positioning member positions the stopper member relative to the synchronously rotatable member in the circumferential direction.

In the valve timing control apparatus of JP2005-155346A (corresponding to US2005/0115528A1), the positioning member functions such that the positioning member limits positional deviation of the stopper member relative to the synchronously rotatable member, which receives the crank torque, when the stopper member stops the rotation of the inner rotor. Here, a shaft portion of the positioning member, which extends straight, is press fitted into a press fitting hole portion of the stopper member, which extends straight. Furthermore, a distal end portion of the positioning member projects into a tapered hole portion of the synchronously rotatable member, which has an inner peripheral surface tapered to have an inner diameter that is progressively increased in the axial direction toward the stopper member. The distal end portion of the positioning member, which projects into the tapered hole portion of the synchronously rotatable member, contacts the inner peripheral surface of the tapered hole portion at a specific side in the circumferential direction. The press fitting configuration and the contacting configuration described above can guarantee positioning of the stopper member relative to the synchronously rotatable member in a manner that absorbs positional deviation of the central axis of the press fitting hole portion and the central axis of the tapered hole portion from its normal position (a specified position) and further guarantee the accuracy of the positioning of the inner rotor at the time of stopping the rotation of the inner rotor regardless of manufacturing tolerance.

However, in the valve timing control apparatus of JP2005-155346A (corresponding to US2005/0115528A1), the positioning member projects from the press fitting hole portion of the stopper member toward the tapered hole portion side. Therefore, at the time of inserting a distal end part of the shaft portion of the positioning member into the tapered hole portion upon press fitting of the shaft portion of the positioning member into the hole portion to form the positioning structure, the shaft portion tends to be caught by the tapered hole portion side edge of the press fitting hole portion. In such a case, as indicated by a solid line in FIG. 14A, a stick-slip phenomenon (also referred to as a slip-stick phenomenon) occurs in a period T, which is from the time of projecting the shaft portion from the press fitting hole portion to the time of contacting the distal end part against the inner peripheral surface of the tapered hole portion at the specific side. The stick-slip phenomenon is a phenomenon of self-oscillation of the positioning member that involves repeat of a moving state (slipping state), which is governed by a small kinetic frictional force between the shaft portion and the press fitting hole portion, and a stop state (sticking state), which is governed by a large kinetic frictional force between the shaft portion and the edge.

When the stick-slip phenomenon of the positioning member occurs, control of a press-in load (also referred to as a press-fit load) applied to the positioning member to insert the positioning member into the press fitting hole portion becomes difficult at the time of contacting of the distal end part of the positioning member against the tapered hole portion. Therefore, in such a case, the press-in load, which is applied to the positioning member, may become excessively large to cause deformation of the synchronously rotatable member. Here, the deformation of the synchronously rotatable member of the outer rotor, which is rotated by the crank torque transmitted from the crankshaft, has an influence on the adjustment accuracy of the valve timing in accordance with the rotational phase between the outer rotor and the inner rotor. Therefore, it is necessary to limit the deformation of the synchronously rotatable member.

SUMMARY

The present disclosure is made in view of the above points.

According to the present disclosure, there is provided a valve timing control apparatus for adjusting valve timing of a subject valve that is opened and closed by a camshaft through transmission of a crank torque from a crankshaft at an internal combustion engine. The valve timing control apparatus includes an outer rotor and an inner rotor. The outer rotor is rotated synchronously with the crankshaft in a circumferential direction. The inner rotor is rotated synchronously with the camshaft in the circumferential direction and is rotatable relative to the outer rotor at an inside of the outer rotor. The outer rotor includes a synchronously rotatable member, a stopper member and a positioning member. The synchronously rotatable member is rotated synchronously with the crankshaft when the synchronously rotatable member receives the crank torque from the crankshaft. The stopper member is rotated integrally with the synchronously rotatable member that is joined to the stopper member in an axial direction. The stopper member stops rotation of the inner rotor that is rotated relative to the outer rotor in the circumferential direction. The positioning member is shaped into a rod form and extends in the axial direction. The positioning member positions the stopper member relative to the synchronously rotatable member in the circumferential direction. The synchronously rotatable member includes a tapered hole portion that is tapered such that an inner diameter of an inner peripheral surface of the tapered hole portion is progressively increased in the axial direction toward the stopper member. The stopper member includes a press fitting hole portion that extends straight in the axial direction. The positioning member is press fitted into the press fitting hole portion. The positioning member includes a contacting distal end portion, a main shaft portion and a loosely inserting shaft portion. The contacting distal end portion is inserted into the tapered hole portion in the axial direction and contacts the inner peripheral surface of the tapered hole portion on a specific side, which is a circumferential side in the circumferential direction. The main shaft portion extends straight in the axial direction and is press fitted into the press fitting hole portion in the axial direction. The loosely inserting shaft portion is formed between the contacting distal end portion and the main shaft portion and is loosely inserted into the press fitting hole portion in the axial direction.

According to the present disclosure, there is also provided a manufacturing method of the valve timing control apparatus according, including a connecting step and a positioning step. In the connecting step, the synchronously rotatable member and the stopper member are connected together in the axial direction. In the positioning step, the positioning member is press fitted into the press fitting hole portion of the stopper member, and the positioning member is further inserted into the tapered hole portion, so that the stopper member is positioned in the circumferential direction relative to the synchronously rotatable member after the synchronously rotatable member and the stopper member are connected together in the connecting step.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings.

Figure 1:
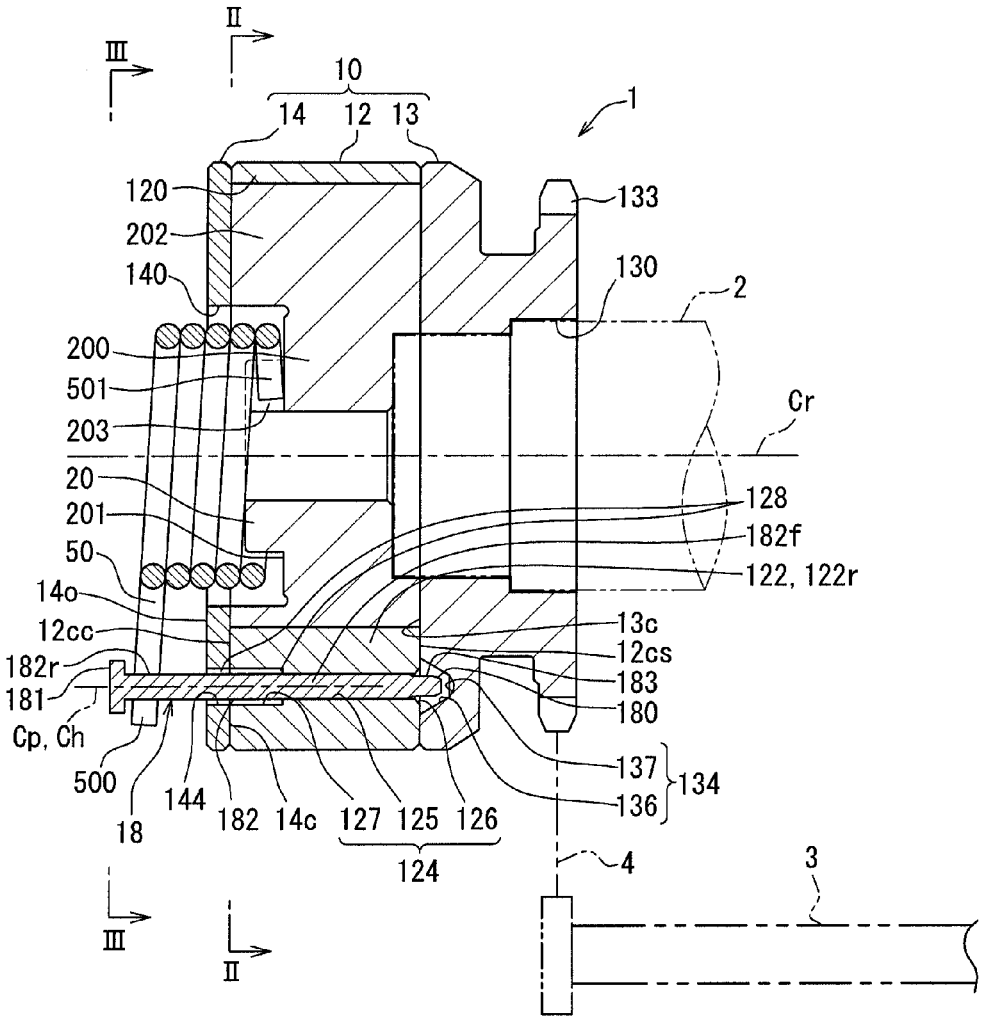
FIG. 1 is a cross sectional view of a valve timing control apparatus according to an embodiment of the present disclosure taken along line I-I in FIG. 2.

As shown in FIG. 1, a valve timing control apparatus 1 of the present embodiment is a hydraulic type that uses a pressure of hydraulic oil. The valve timing control apparatus 1 is installed in a transmission system that transmits a crank torque, which is outputted from a crankshaft 3, to a camshaft 2 through a timing chain 4 at an internal combustion engine. The camshaft 2 opens and closes exhaust valves (serving as subject valves of the present disclosure, which may be simply referred to as valves) when the crank torque is transmitted from the crankshaft 3 to the camshaft 2. The valve timing control apparatus 1 adjusts valve timing of the exhaust valves.

Figure 2:
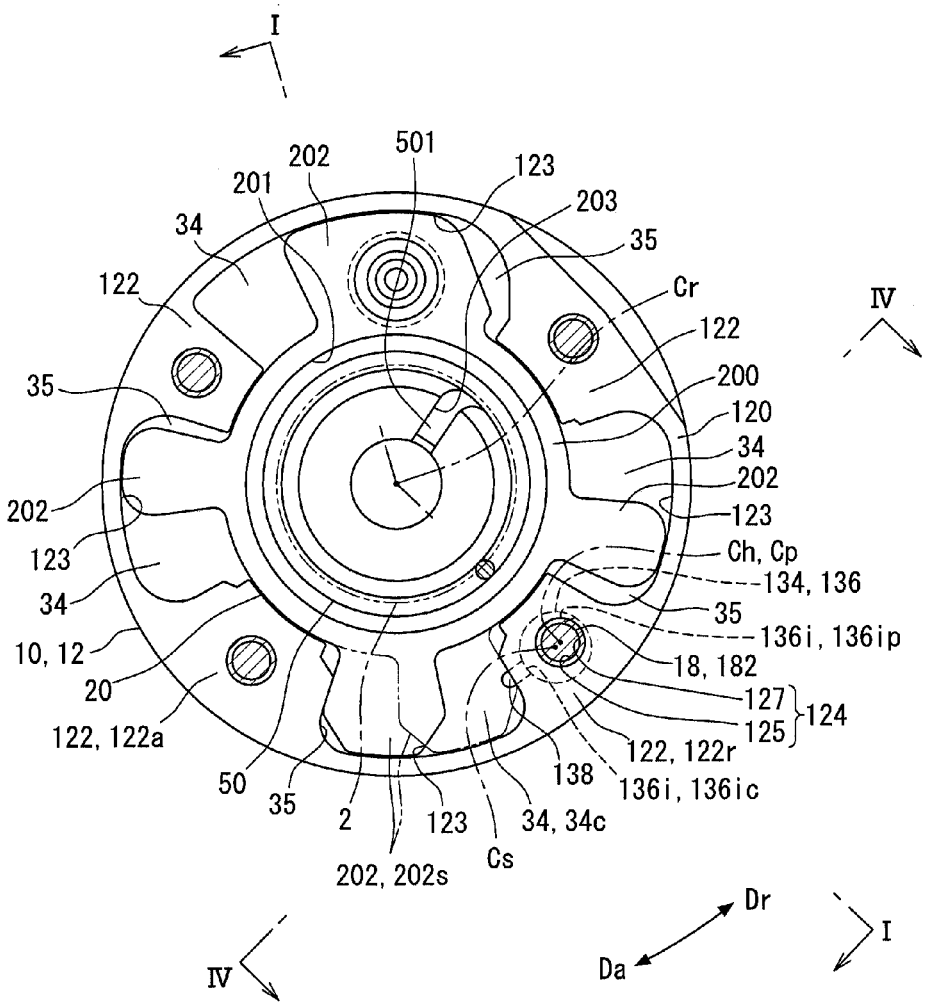
FIG. 2 is a cross sectional view taken along line II-II in FIG. 1.
Figure 3:
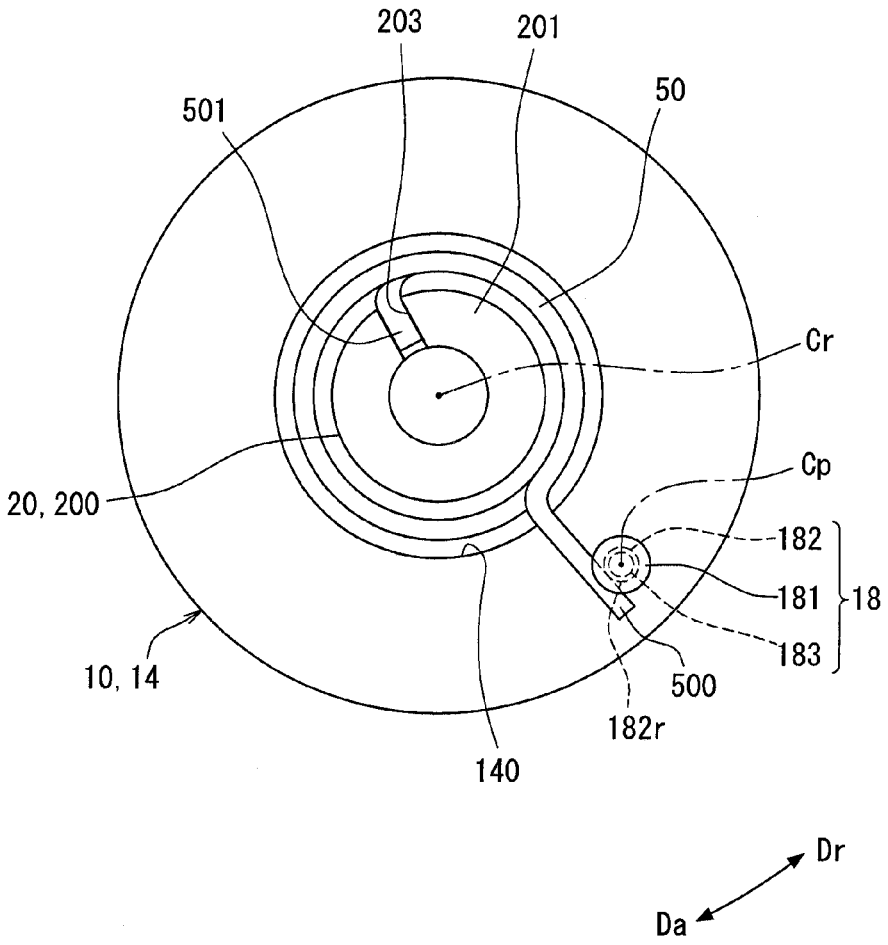
FIG. 3 is a cross sectional view taken along line III-Ill in FIG. 1.

As shown in FIGS. 1 to 3, the valve timing control apparatus 1 includes an outer rotor 10, an inner rotor 20 and a torsion spring 50. In the valve timing control apparatus 1, the inner rotor 20 is rotated relative to the outer rotor 10 to adjust the valve timing according to a rotational phase between the outer rotor 10 and the inner rotor 20.

The outer rotor 10 is made of metal and is formed as a sprocket housing in such a manner that a sprocket plate 13 and a cover plate 14 are placed on one axial side and another axial side of a shoe housing 12, and the sprocket plate 13, the shoe housing 12 and the cover plate 14 are fixed together by bolts. In the outer rotor 10, the shoe housing 12 is positioned relative to the sprocket plate 13 in the circumferential direction by a positioning member 18. The positioning member 18, which is made of metal and is shaped into an elongated rod form, is installed to the sprocket plate 13, the shoe housing 12 and the cover plate 14 and is thereby elongated in the axial direction. Thus, the outer rotor 10 includes the above-described components, i.e., the shoe housing 12, the sprocket plate 13, the cover plate 14 and the positioning member 18.

As shown in FIGS. 1 and 2, the shoe housing 12 includes a receiving tube 120 and a plurality of shoes 122, which are integrally formed as one-piece component. The shoes 122 are formed at predetermined locations, which are placed one after another at predetermined intervals in a circumferential direction along an inner peripheral surface of the receiving tube 120 configured into a cylindrical tubular form, and each of the shoes 122 is shaped into a generally fan form and radially inwardly projects. A receiving chamber 123 is formed between each circumferentially adjacent two of the shoes 122 in the shoe housing 12.

As shown in FIGS. 1 and 3, the sprocket plate 13 has a center hole 130, which extends through the sprocket plate 13 in the axial direction, and the cover plate 14 has a center hole 140, which extends through the cover plate 14 in the axial direction. As shown in FIG. 1, the sprocket plate 13 includes a plurality of sprocket teeth 133. The sprocket teeth 133 are formed at predetermined locations, which are placed one after another at equal intervals in a circumferential direction along an outer peripheral surface of the sprocket plate, and each of the sprocket teeth 133 is shaped into a generally fan form and radially outwardly projects. The sprocket plate 13 is coupled to the crankshaft 3 by a timing chain 4, which is wound around the sprocket teeth 133 and teeth of the crankshaft 3. With this coupling between the sprocket plate 13 and the crankshaft 3, the sprocket plate (serving as a synchronously rotatable member) 13 of the outer rotor 10 receives the crank torque of the crankshaft 3 through the timing chain 4 at the time of operating the internal combustion engine. Therefore, the constituent components 12, 13, 14, 18 of the outer rotor 10 are rotated together synchronously with the crankshaft 3 in the circumferential direction (a clockwise direction in FIG. 2).

As shown in FIGS. 1 and 2, the inner rotor 20, which is made of metal, is a vane type and is received in an inside of the outer rotor 10.

The inner rotor 20 includes a rotatable shaft 200 and a plurality of vanes 202, which are integrally formed as one-piece component. The rotatable shaft 200, which is shaped into a cylindrical tubular form, is coaxially placed in an inside of the outer rotor 10. As shown in FIGS. 1 to 3, the rotatable shaft 200 includes a center recess 201 and an anchoring groove 203. The center recess 201 is formed as a cylindrical recess and opens in the axial direction toward the cover plate 14. The anchoring groove 203 is formed as a rectangular groove and opens in an inner peripheral surface of the center recess 201.

With reference to FIGS. 1 and 2, the rotatable shaft 200 is coaxially joined to the camshaft 2, which is inserted into the center hole 130 of the sprocket plate 13, by a bolt. With this construction, the inner rotor 20 is rotated synchronously with the camshaft 2 in one circumferential direction (the clockwise direction in FIG. 2) and is rotatable relative to the outer rotor 10 in two opposite circumferential directions (the clockwise direction and the counter clockwise direction in FIG. 2). At the time of rotating the inner rotor 20 relative to the outer rotor 10, one axial end surface and the other axial end surface of the rotatable shaft 200 are slid relative to the sprocket plate 13 and the cover plate 14, respectively. Also, at the same time, an outer peripheral surface of the rotatable shaft 200 is slid relative to projecting distal end surfaces (radially inner end surfaces) of the shoes 122.

As shown in FIG. 2, the vanes 202 are formed at predetermined locations, which are placed one after another at predetermined intervals in the circumferential direction along an outer peripheral surface of the rotatable shaft 200, and each of the vanes 202 is shaped into a generally fan form and radially outwardly projects. Each of the vanes 202 is inserted into a corresponding one of the receiving chambers 123. At the time of rotating the inner rotor 20 relative to the outer rotor 10, one axial end surface and the other axial end surface of each vane 202 are slid relative to the sprocket plate 13 and the cover plate 14, respectively. Also, at the same time, a projecting distal end surface (radially outer end surface) of each vane 202 is slid relative to an inner peripheral surface of the receiving tube 120.

Each of the vanes 202 partitions the corresponding one of the receiving chambers 123 in the circumferential direction to form an advancing working chamber 34 and a retarding working chamber 35 in the receiving chamber 123. In this way, in the internal combustion engine, when the hydraulic oil, which is discharged from the pump, is guided into the advancing working chambers 34 through operation of an oil pressure control valve, a rotational torque, which rotates the inner rotor 20 relative to the outer rotor 10 toward an advancing side Da in the circumferential direction, is generated. At this time, in the internal combustion engine, the hydraulic oil is discharged from each retarding working chamber 35 to a drain (e.g., an oil pan) through operation of the oil pressure control valve. Thus, the rotational phase of the inner rotor 20 relative to the outer rotor 10 is advanced, and thereby the valve timing is advanced. In contrast, in the internal combustion engine, when the hydraulic oil, which is discharged from the pump, is guided into the retarding working chambers 35 through operation of the oil pressure control valve, a rotational torque, which rotates the inner rotor 20 relative to the outer rotor 10 toward a retarding side Dr in the circumferential direction, is generated. At this time, in the internal combustion engine, the hydraulic oil is discharged from each advancing working chamber 34 to the drain through operation of the oil pressure control valve. Thus, the rotational phase of the inner rotor 20 relative to the outer rotor 10 is retarded, and thereby the valve timing is retarded.

A stopper vane 202*s*, which is a specific one of the vanes 202, is inserted into the receiving chamber 123 formed between an advancing stopper shoe 122*a* and a retarding stopper shoe 122*r*, which are specific two of the shoes 122. As indicated by a solid line in FIG. 2, the advancing stopper shoe 122*a* stops further rotation of the inner rotor 20 toward the advancing side Da when the advancing stopper shoe 122*a* abuts against the stopper vane 202*s* of the inner rotor 20, which is rotated relative to the outer rotor 10 toward the advancing side Da in the circumferential direction. In contrast, as indicated by a dot-dot-dash line in FIG. 2, the retarding stopper shoe 122*r* stops further rotation of the inner rotor 20 toward the retarding side Dr when the retarding stopper shoe 122*r* abuts against the stopper vane 202*s* of the inner rotor 20, which is rotated relative to the outer rotor 10 toward the retarding side Dr in the circumferential direction. Thereby, the shoe housing 12, which includes the advancing stopper shoe 122*a* and the retarding stopper shoe 122*r*, forms a stopper member.

With reference to FIGS. 1 to 3, the torsion spring 50, which is made of metal, is a torsion coil spring that is formed by winding a spring wire into a cylindrical coil form about the axis. The torsion spring 50 is coaxially placed in an inside and an outside of the center hole 140 of the cover plate 14. One end portion 500 of the torsion spring 50 is always engaged with, i.e., is always anchored to the positioning member 18 to apply the restoring force to the outer rotor 10 toward the retarding side Dr. The other end portion 501 of the torsion spring 50, which is opposite from the one end portion 500, is always engaged with the anchoring groove 203 to apply the restoring force to the inner rotor 20 toward the advancing side Da. With the above construction, when the inner rotor 20 is rotated relative to the outer rotor 10, which receives the crank torque, toward the retarding side Dr in the circumferential direction, the restoring force, which is generated by the torsion spring 50, is increased to urge the inner rotor 20 toward the advancing side Da relative to the outer rotor 10. Specifically, the torsion spring 50 forms a resilient member. In place of the torsion coil spring, which is in the cylindrical coil form, the torsion spring 50 may be formed by a spiral spring (e.g., a mainspring, a flat coil spring).

Next, the positioning structure of the outer rotor 10, which uses the positioning member 18, will be described in detail.

In the following discussion, the axial direction, the radial direction and the circumferential direction of the outer rotor 10 will be simply referred to as the axial direction, the radial direction and the circumferential direction, respectively.

Figure 4:
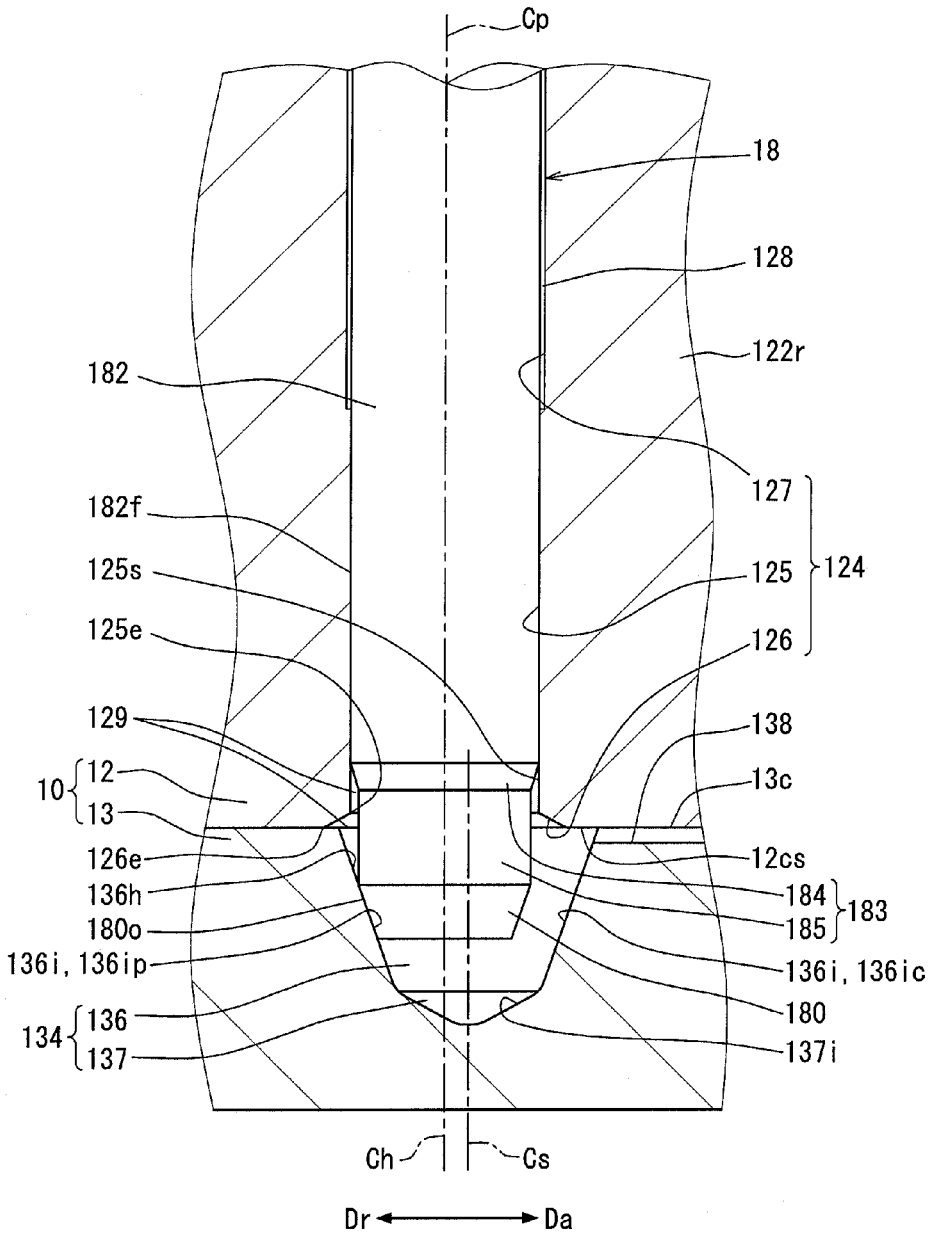
FIG. 4 is an enlarged cross sectional view taken along line IV-IV in FIG. 2, showing a positioning member and its surroundings according to the embodiment.

As shown in FIGS. 1, 2 and 4, the sprocket plate 13 of the outer rotor 10 includes a blind hole 134 (i.e., a hole that is, for example, reamed, drilled, or milled to a specified depth without breaking through to the other side of the sprocket plate 13). The blind hole 134 is formed at a location that is eccentric from, i.e., is displaced from a rotational central axis Cr of the outer rotor 10 in the radial direction in such a manner that a tapered hole portion 136 and a bottom hole portion 137 are coaxially formed in the blind hole 134. Therefore, a common central axis Cs (see FIG. 4), which is common to the tapered hole portion 136 and the bottom hole portion 137, is set to be substantially parallel to the rotational central axis Cr.

The tapered hole portion 136 opens in a contact surface 13*c* of the sprocket plate 13, against which the shoe housing 12 contacts in the axial direction. As shown in FIG. 4, an inner peripheral surface 136*i* of the tapered hole portion 136 is tapered (is formed in a conical form) such that an inner diameter of the inner peripheral surface 136*i* is progressively increased in the axial direction toward the shoe housing 12. Here, a taper angle of the inner peripheral surface 136*i* of the tapered hole portion 136 is set to, for example, about 40 degrees.

The bottom hole portion 137 is formed on an opposite side of the tapered hole portion 136, which is opposite from the shoe housing 12 in the axial direction. A bottom side of the bottom hole portion 137, which is opposite from the tapered hole portion 136 in the axial direction, is closed. An inner peripheral surface 137*i* of the bottom hole portion 137 is tapered (is formed in a conical form) such that an inner diameter of the inner peripheral surface 137*i* is progressively increased in the axial direction toward the tapered hole portion 136. Here, a taper angle of the inner peripheral surface 137*i* of the bottom hole portion 137 is set to be larger than the taper angle of the tapered hole portion 136.

As shown in FIGS. 2 and 4, the sprocket plate 13 of the outer rotor 10 includes a communication groove 138. The communication groove 138 is formed in a form of a bottomed groove (a groove having a closed bottom) that opens to the contact surface 13*c* and the inner peripheral surface 136*i* of the tapered hole portion 136. A portion of the contact surface 13*c*, at which the communication groove 138 opens, is exposed to a communication working chamber 34*c*, which is a specific one of the advancing working chambers 34. Furthermore, a portion of the inner peripheral surface 136*i* of the tapered hole portion 136, at which the communication groove 138 opens, forms a communication surface portion 136*ic* on the advancing side Da of the common central axis Cs in the circumferential direction. With the above structure, the blind hole 134 can be opened to the atmosphere through the communication groove 138 and the communication working chamber 34*c* at the time of assembling the valve timing control apparatus 1 described later.

As shown in FIGS. 1, 2 and 4, the shoe housing 12 of the outer rotor 10 has a through hole 124 that axially extends through a retarding stopper shoe 122*r*, which is one of the shoes 122 and partitions, i.e., defines the communication working chamber 34*c*. The through hole 124 is formed at the location that is eccentric from, i.e., is displaced from the rotational central axis Cr of the outer rotor 10 in the radial direction in such a manner that a press fitting hole portion 125, a chamfered hole portion 126 and a guide hole portion 127 are coaxially formed in the through hole 124. Therefore, a common central axis Ch, which is common to the press fitting hole portion 125, the chamfered hole portion 126 and the guide hole portion 127, is set to be substantially parallel to the rotational central axis Cr. Also, the common central axis Ch is substantially parallel to the common central axis Cs of the blind hole 134 and is eccentric to the common central axis Cs of the blind hole 134 in the circumferential direction toward the retarding side Dr.

A length of the press fitting hole portion 125, which is measured in the axial direction, is set such that the press fitting hole portion 125 does not reach to a contact surface 12*cs* of the shoe housing 12, which contacts the sprocket plate 13, and a contact surface 12*cc* of the shoe housing 12, which contacts the cover plate 14. The press fitting hole portion 125 extends straight in the axial direction as a cylindrical hole portion that has a substantially constant inner diameter along an entire extent of the press fitting hole portion 125. The inner diameter of the press fitting hole portion 125, which is measured before or after the press fitting of the main shaft portion 182 into the press fitting hole portion 125, is set to be smaller than a maximum inner diameter of the tapered hole portion 136 along the entire axial extent of the press fitting hole portion 125.

The chamfered hole portion 126 opens at the contact surface 12*cs* of the shoe housing 12, which contacts the sprocket plate 13. The chamfered hole portion 126 is formed continuously between the contact surface 12*cs* and the press fitting hole portion 125 in the axial direction. As shown in FIG. 4, an inner diameter of the chamfered hole portion 126 is progressively increased from an edge 125*e*, which forms a boundary between the chamfered hole portion 126 and the press fitting hole portion 125, toward an edge 126*e*, which forms a boundary between the chamfered hole portion 126 and the contact surface 12*cs*. The chamfered hole portion 126, which has the progressively increasing inner diameter as discussed above, chamfers an opening edge portion of the through hole 124 at the contact surface 12*cs*. Here, the inner diameter of the chamfered hole portion 126 is set to be smaller than the maximum inner diameter of the tapered hole portion 136 along the entire axial extent of the chamfered hole portion 126.

As shown in FIG. 1, the guide hole portion 127 opens at the contact surface 12*cc* of the shoe housing 12, which contacts the cover plate 14. The guide hole portion 127 is formed on an opposite side of the press fitting hole portion 125, which is opposite from the chamfered hole portion 126 in the axial direction. The guide hole portion 127 extends straight in the axial direction as a cylindrical hole portion that has a substantially constant inner diameter, which is larger than the inner diameter of the press fitting hole portion 125 measured before or after the press fitting of the main shaft portion 182 into the press fitting hole portion 125, along an entire axial extent of the guide hole portion 127. Here, the inner diameter of the guide hole portion 127 is set to be smaller than the maximum inner diameter of the tapered hole portion 136 along the entire axial extent of the guide hole portion 127.

The cover plate 14 of the outer rotor 10 includes a through hole 144. The through hole 144 of the cover plate 14 is formed at a location that is eccentric from, i.e., is displaced from the rotational central axis Cr of the outer rotor 10 in the radial direction in such a manner that the through hole 144 can be coaxially aligned with the through hole 124 of the shoe housing 12. Therefore, the common central axis Ch, which is also common to the through hole 144 of the cover plate 14 and the through hole 124 of the shoe housing 12, is set to be substantially parallel to the rotational central axis Cr and the common central axis Cs.

One end of the through hole 144 opens at the contact surface 14*c* of the cover plate 14, which contacts the shoe housing 12 in the axial direction, and the other end of the through hole 144 opens at an outer surface 14*o* of the cover plate 14, which is opposite from the shoe housing 12 in the axial direction. The through hole 144 extends straight in the axial direction as a cylindrical hole portion that has a substantially constant inner diameter between the contact surface 14*c* and the outer surface 14*o* of the cover plate 14. Here, the inner diameter of the through hole 144 is set to be larger than the inner diameter of the press fitting hole portion 125, which is measured before or after the press fitting of the main shaft portion 182 into the press fitting hole portion 125, along an entire axial extent of the through hole 144.

As shown in FIGS. 1 to 4, the positioning member 18 is inserted into the holes 134, 124, 144 of the outer rotor 10 at the location, which is eccentric from, i.e., is displaced from the rotational central axis Cr of the outer rotor 10 in the radial direction. The positioning member 18 includes a contacting distal end portion 180, an anchoring head portion 181, a main shaft portion 182 and a loosely inserting shaft portion 183, which are coaxial with each other. Therefore, a common central axis Cp, which is common to the contacting distal end portion 180, the anchoring head portion 181, the main shaft portion 182 and the loosely inserting shaft portion 183, is substantially parallel to the rotational central axis Cr and the common central axis Cs.

As shown in FIGS. 1 and 4, the contacting distal end portion 180 is formed at one axial end portion of the positioning member 18, which is located on the sprocket plate 13 side in the axial direction. The contacting distal end portion 180 is axially inserted into the tapered hole portion 136 of the blind hole 134, which opens toward the shoe housing 12. As shown in FIG. 4, an outer peripheral surface 180*o* of the contacting distal end portion 180 is tapered (is formed in a conical form) such that an outer diameter of the outer peripheral surface 180*o* of the contacting distal end portion 180 is progressively increased in the axial direction toward the shoe housing 12.

The outer diameter of the contacting distal end portion 180 is set to be smaller than the maximum inner diameter of the tapered hole portion 136 along an entire axial extent of the contacting distal end portion 180. Furthermore, a taper angle of the outer peripheral surface 180*o* of the contacting distal end portion 180 is set be the same as the taper angle of the tapered hole portion 136. Furthermore, a length of a generatrix of the outer peripheral surface 180*o* of the contacting distal end portion 180 is set be smaller than a length of a generatrix of the inner peripheral surface 136*i* of the tapered hole portion 136. With the above settings, the contacting distal end portion 180 is eccentric to the tapered hole portion 136 in the circumferential direction toward the retarding side Dr. Furthermore, with the above settings, the outer diameter of the outer peripheral surface 180*o* of the contacting distal end portion 180 is progressively increased along the inner peripheral surface 136*i* of the tapered hole portion 136. Furthermore, the outer peripheral surface 180*o* of the contacting distal end portion 180 contacts the inner peripheral surface 136*i* of the tapered hole portion 136 along the generatrix of the inner peripheral surface 136*i* on the retarding side Dr of the common central axis Cs in the circumferential direction. That is, with reference to FIGS. 2 and 4, a portion of the inner peripheral surface 136*i* of the tapered hole portion 136, which contacts the outer peripheral surface 180*o* of the contacting distal end portion 180, forms a positioning surface portion 136*ip* on the retarding side Dr (serving as a specific side, which is a circumferential side in the circumferential direction).

As shown in FIGS. 1 and 3, the anchoring head portion 181 is formed in the other end portion of the positioning member 18, which is located on the outer side of the cover plate 14 in the axial direction. The anchoring head portion 181 is shaped into a circular disk form and is formed as a maximum diameter portion in the positioning member 18. That is, the outer diameter of the anchoring head portion 181 is set to be larger than the outer diameters of the other portions 180, 182, 183 of the positioning member 18.

As shown in FIGS. 1 to 4, the main shaft portion 182 is formed continuously from the anchoring head portion 181 in the positioning member 18. The main shaft portion 182 extends straight in the axial direction as a cylindrical portion and has a substantially constant outer diameter along an entire extent of the main shaft portion 182 in the positioning member 18. As shown in FIG. 4, a part of the main shaft portion 182, which is located on the sprocket plate 13 side, is press fitted into the press fitting hole portion 125 except a part 125*s* of the press fitting hole portion 125 located at the sprocket plate 13 side to form an actual press fitting part 182*f* (also see FIG. 1). Specifically, the actual press fitting part 182*f* of the main shaft portion 182 refers to a part of the main shaft portion 182, which is actually securely press fitted to the press fitting hole portion 125. The outer diameter of the actual press fitting part 182*f* before the press fitting thereof is set to be slightly larger than the inner diameter of the press fitting hole portion 125 before the press fitting along the entire axial extent of the actual press fitting part 182*f*. With the above settings, when the press fit interference of the actual press fitting part 182*f* relative to the press fitting hole portion 125 is ensured to be, for example, 10 to 70 μm, the required anchorage strength of the actual press fitting part 182*f* relative to the press fitting hole portion 125 is ensured.

As shown in FIGS. 1 and 3, a part of the main shaft portion 182, which projects outward from the cover plate 14, cooperates with the anchoring head portion 181 having the large diameter to hold the one end portion 500 of the torsion spring 50 and thereby forms a receiving part 182*r*. The receiving part 182*r*, which is located on the retarding side Dr of the torsion spring 50 in the circumferential direction, holds the torsion spring 50, so that the receiving part 182*r* receives the restoring force of the torsion spring 50, which is applied to the receiving part 182*r* in the circumferential direction toward the retarding side Dr.

As shown in FIGS. 1 and 4, a part of the main shaft portion 182, which is located between the actual press fitting part 182*f* and the receiving part 182*r*, is loosely inserted into the guide hole portion 127 and the through hole 144 in the axial direction along the entire extent of the guide hole portion 127 and the through hole 144. Because of this loose insertion, the main shaft portion 182 forms a gap 128, which is shaped into a continuous annular form and is radially defined between the part of the main shaft portion 182 and inner peripheral surfaces of the guide hole portion 127 and the through hole 144.

The loosely inserting shaft portion 183 is continuously formed between the contacting distal end portion 180 and the main shaft portion 182 in the axial direction in the positioning member 18. As shown in FIG. 4, the loosely inserting shaft portion 183 includes a conical part 184, which is tapered (i.e., shaped into a conical form), and a cylindrical part 185, which is shaped into a cylindrical form, and the conical part 184 and the cylindrical part 185 are coaxially formed together. An outer diameter of the conical part 184 is progressively reduced from a boundary between the main shaft portion 182 and the conical part 184 in the axial direction toward the contacting distal end portion 180. The cylindrical part 185, which has a constant outer diameter, extends straight in the axial direction from the conical part 184 to the contacting distal end portion 180 in the positioning member 18.

The outer diameter of the loosely inserting shaft portion 183 is set to be smaller than the outer diameter of the main shaft portion 182 and the inner diameter of the press fitting hole portion 125, which is measured before or after the press fitting of the main shaft portion 182 into the press fitting hole portion 125, along the entire axial extent of the loosely inserting shaft portion 183. For example, the outer diameter of the loosely inserting shaft portion 183 is set to be about 3.8 mm relative to the main shaft portion 182, which has the outer diameter of about 4.0 mm that is measured before the press fitting of the main shaft portion 182 into the press fitting hole portion 125. With the above settings, the loosely inserting shaft portion 183 is loosely inserted into a part 125*s* of the press fitting hole portion 125, which is located on the sprocket plate 13 side, an entire extent of the chamfered hole portion 126, and a part 136*h* of the tapered hole portion 136, which is located on the shoe housing 12 side. Because of this loose insertion, the loosely inserting shaft portion 183 forms a gap 129, which is shaped into a continuous annular form and is radially defined between the loosely inserting shaft portion 183 and inner peripheral surfaces of the press fitting hole portion 125, the chamfered hole portion 126 and the tapered hole portion 136.

Next, a manufacturing method of the valve timing control apparatus 1 of the present embodiment will be described with reference to a flowchart of FIG. 5.

First of all, at step S101, a connecting step is executed. Thereby, the shoe housing 12, which receives the inner rotor 20 therein, the sprocket plate 13 and the cover plate 14 are connected together, i.e., are joined together in the axial direction by the bolts. At this time, the blind hole 134, which includes the tapered hole portion 136, is opened to the surrounding atmosphere through the communication groove 138 and the communication working chamber 34*c*. Furthermore, at this time, the through hole 124, which includes the press fitting hole portion 125, and the through hole 144 are eccentrically displaced relative to the blind hole 134, which includes the tapered hole portion 136, on the retarding side Dr. Here, the amount of eccentricity of the through holes 124, 144 relative to the blind hole 134 tends to be influenced by a manufacturing tolerance. Thus, the central axis of the press fitting hole portion 125 and the central axis of the tapered hole portion 136 may possibly be deviated from normal positions (specified positions) thereof, which are set by the design specification.

Next, at step S102, a positioning step is executed such that the positioning member 18 is installed to the shoe housing 12, the sprocket plate 13 and the cover plate 14, which are joined together. Specifically, the positioning member 18, which is inserted through the through hole 144, is further inserted into the through hole 124 in the axial direction. Thereby, the contacting distal end portion 180 and the loosely inserting shaft portion 183 are sequentially loosely inserted into the press fitting hole portion 125, and then the main shaft portion 182 is press fitted into the press fitting hole portion 125. At this time, a press-in speed of the positioning member 18, which is the amount of stroke of the positioning member 18 per unit time, is controlled to be a constant speed. Thus, a press-in load, which is a load applied to the positioning member 18 to press the positioning member 18 into the press fitting hole portion 125, is progressively increased, as indicated by a solid line in a period A in FIG. 6. Thereby, a press-in length of the main shaft portion 182 (i.e., a length of the press fitted part of the main shaft portion 182) in the press fitting hole portion 125 is progressively increased while the contacting distal end portion 180 and the loosely inserting shaft portion 183 pass through the chamfered hole portion 126 and enter the tapered hole portion 136. As discussed above, at step S102, the main shaft portion 182 is first press fitted into the press fitting hole portion 125 in the axial direction, and the contacting distal end portion 180 is then inserted into the tapered hole portion 136 in the axial direction.

Figure 14A:
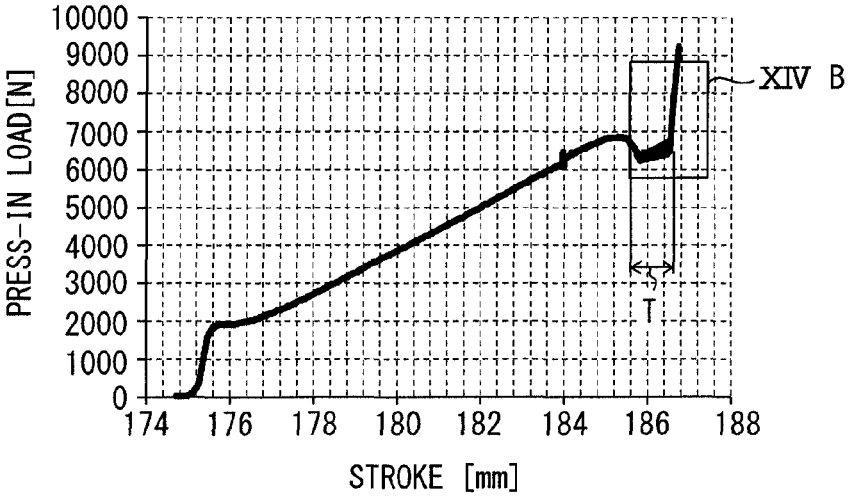
FIG. 14A PRIOR ART
FIG. 14A is a characteristic diagram for describing a characteristic of a prior art valve timing control apparatus.
Figure 14B:
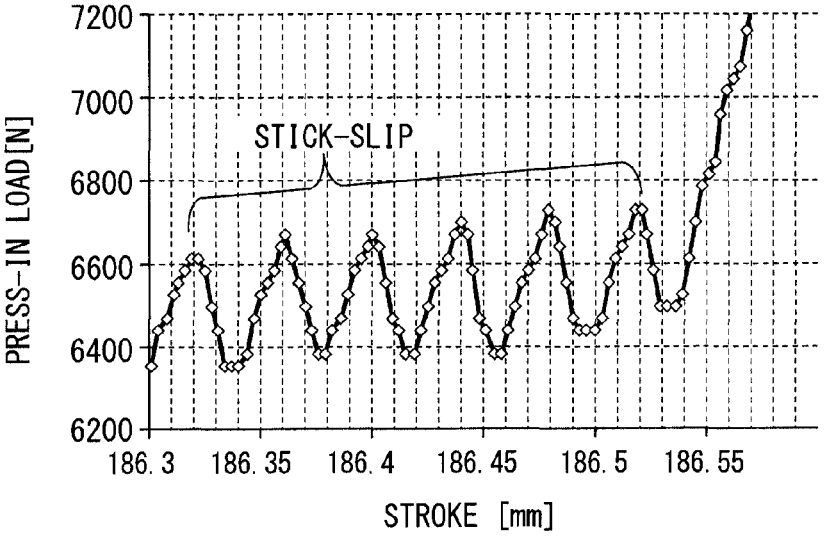
FIG. 14B PRIOR ART
FIG. 14B is an enlarged view of an area XIVB in FIG. 14A.

At step S102, when the press-in length of the main shaft portion 182 in the press fitting hole portion 125 reaches a maximum value of the product, the outer peripheral surface 180*o* of the contacting distal end portion 180, which is projected into the tapered hole portion 136, contacts the inner peripheral surface 136*i* of the tapered hole portion 136 on the retarding side Dr in the circumferential direction. That is, the tapered outer peripheral surface 180*o* of the contacting distal end portion 180 contacts the positioning surface portion 136*ip* of the inner peripheral surface 136*i*, which is located on the retarding side Dr, along the generatrix in the tapered hole portion 136. At this time, the press-in load applied to the positioning member 18 is rapidly increased, as indicated by a solid line in a period B in FIG. 6. Thus, the press fitting of the main shaft portion 182 into the press fitting hole portion 125 is terminated at a maximum press-in length of each product by sensing the rapid increase in the press-in load. As a result, the main shaft portion 182, which extends straight, does not reach to the part 125*s* of the press fitting hole portion 125, which is located on the sprocket plate 13 side. Therefore, the main shaft portion 182 does not project from the edge 125*e* of the press fitting hole portion 125 on the tapered hole portion 136 side (see FIG. 4). In this way, the stick-slip phenomenon of the prior art technique, which is indicated by the dot-dot-dash line in the time period T in FIG. 6 (the solid line in FIG. 14A), does not occur in the valve timing control apparatus of the present embodiment, as indicated by a solid line in FIG. 6.

Thereby, at step S102, the outer peripheral surface 180*o* of the contacting distal end portion 180 contacts the inner peripheral surface 136*i* of the tapered hole portion 136 on the retarding side Dr in the circumferential direction, so that the shoe housing 12 is positioned relative to the sprocket plate 13 in the circumferential direction.

Figure 5:
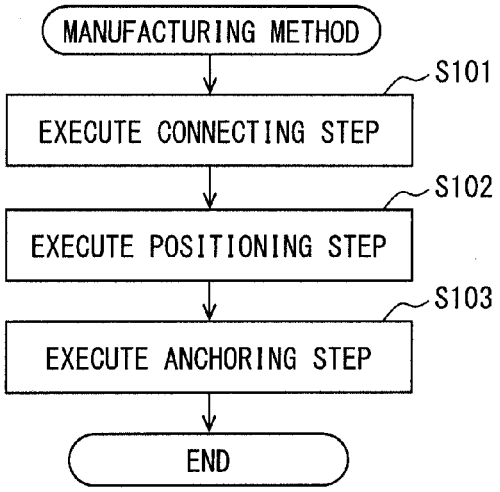
FIG. 5 is a flowchart for describing a manufacturing method of the valve timing control apparatus according to the embodiment.

As shown in FIG. 5, according to the manufacturing method of the present embodiment, the operation proceeds from step S102 to step S103 where an anchoring step is executed. Thereby, the torsion spring 50 is anchored to the outer rotor 10 and the inner rotor 20. The manufacturing method of the valve timing control apparatus 1 is now completed, and the thus manufactured valve timing control apparatus 1 is installed in place such that the inner rotor 20 is joined to the camshaft 2, which is inserted into the center hole 130 of the sprocket plate 13, by the bolt, and the sprocket plate 13 is coupled to the crankshaft 3 through the timing chain 4. Thereby, the valve timing control apparatus 1 of the present embodiment is now ready to be used.

Now, the operation and the advantages of the present embodiment will be described.

In the valve timing control apparatus 1, the contacting distal end portion 180 of the positioning member 18 is inserted into the tapered hole portion 136 of the sprocket plate 13 in the axial direction, and the main shaft portion 182 of the positioning member 18, which extends straight in the axial direction, is press fitted into the press fitting hole portion 125, which extends straight, in the shoe housing 12. The loosely inserting shaft portion 183, which is placed between the contacting distal end portion 180 and the main shaft portion 182 in the positioning member 18, is loosely inserted into the press fitting hole portion 125 in the axial direction. Thereby, the contacting distal end portion 180 of the positioning member 18 contacts the inner peripheral surface 136*i* of the tapered hole portion 136 on the retarding side Dr in the circumferential direction while the main shaft portion 182 of the positioning member 18 does not project from the press fitting hole portion 125 toward the tapered hole portion 136. Thereby, the main shaft portion 182 is first press fitted into the press fitting hole portion 125, and the contacting distal end portion 180 is then inserted into the tapered hole portion 136. Thus, the main shaft portion 182 is not caught by the edge 125*e* on the tapered hole portion 136 side of the press fitting hole portion 125 at the time of positioning the shoe housing 12 relative to the sprocket plate 13 in the circumferential direction.

Figure 6:
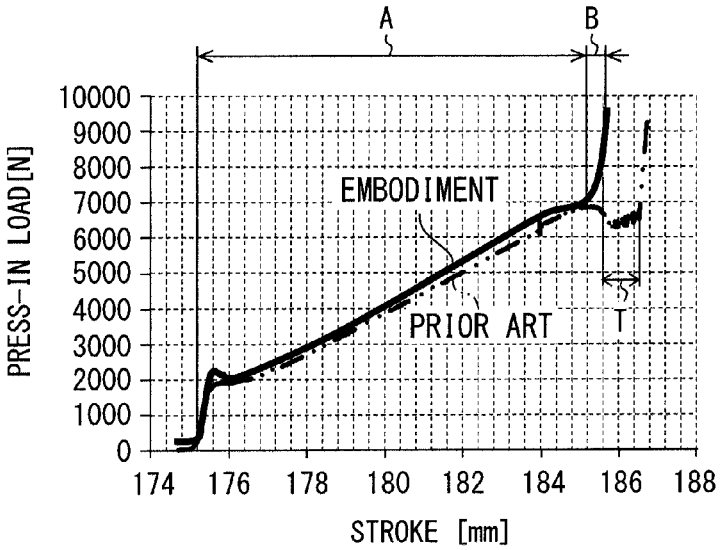
FIG. 6 is a characteristic diagram showing comparison of a characteristic of the valve timing control apparatus of the embodiment and a characteristic of a prior art valve timing control apparatus.

Thus, as shown in FIG. 6, through use of the positioning member 18, which limits generation of the stick-slip phenomenon, the press-in load can be easily controlled at the time of contacting the contacting distal end portion 180 against the inner peripheral surface 136*i* of the tapered hole portion 136 on the retarding side Dr, i.e., the time of contacting the contacting distal end portion 180 against the positioning surface portion 136*ip*. As a result, it is possible to limit deformation of the sprocket plate 13 caused by application of excessive press-in load. Therefore, since the deformation of the sprocket plate 13 is limited, it is possible to achieve the required adjustment accuracy of the valve timing, which corresponds to the rotational phase between the outer rotor 10, which includes the sprocket plate 13, and the inner rotor 20, which is placed in the inside of the outer rotor 10.

Furthermore, in the shoe housing 12 of the valve timing control apparatus 1, the chamfered hole portion 126 is placed between the contact surface 12*cs*, which contacts the sprocket plate 13, and the press fitting hole portion 125, such that the inner diameter of the chamfered hole portion 126 progressively increases from the press fitting hole portion 125. Therefore, the edge 125*e*, which forms the boundary between the chamfered hole portion 126 and the press fitting hole portion 125, and the edge 126*e*, which forms the boundary between the contact surface 12*cs* and the chamfered hole portion 126, do not catch the main shaft portion 182, which is press fitted into the press fitting hole portion 125. Therefore, the press-in load can be easily controlled, and the deformation of the sprocket plate 13 can be reliably limited. Thus, the reliability with respect to the achievement of the required adjustment accuracy of the valve timing can be improved.

Furthermore, the torsion spring 50, which urges the inner rotor 20 against the outer rotor 10, is anchored to, i.e., hooked to the positioning member 18 of the valve timing control apparatus 1, so that the positioning member 18 receives the restoring force of the torsion spring 50 in the circumferential direction toward the retarding side Dr. Therefore, the contacting distal end portion 180 is urged against the positioning surface portion 136*ip* located on the retarding side Dr in the circumferential direction. Therefore, the accuracy of the positioning of the inner rotor 20 at the time of limiting the rotation of the inner rotor 20 with the shoe housing 12 is improved, so that the required adjustment accuracy of the valve timing can be ensured.

Furthermore, in the valve timing control apparatus 1, the outer peripheral surface 180*o* of the contacting distal end portion 180 is tapered such that the outer diameter of the outer peripheral surface 180*o* of the contacting distal end portion 180 is progressively increased in the axial direction toward the shoe housing 12 side along the inner peripheral surface 136*i* of the tapered hole portion 136. Thus, the tapered outer peripheral surface 180*o* can contact the positioning surface portion 136*ip*, which is located on the retarding side Dr in the circumferential direction, along the entire extent of the generatrix of the tapered outer peripheral surface 180*o*. Therefore, the accuracy of the positioning of the inner rotor 20 at the time of limiting the rotation of the inner rotor 20 with the shoe housing 12 is improved, so that the required adjustment accuracy of the valve timing can be ensured.

In addition, the blind hole 134, which is formed in the sprocket plate 13 in the valve timing control apparatus 1 and includes the tapered hole portion 136, can be opened to the atmosphere. Therefore, the air, which is present in the blind hole 134, may be discharged to the atmosphere side in response to an increase in the amount of projection of the contacting distal end portion 180 into the tapered hole portion 136. As a result, it is possible to avoid the functioning of the air, which is present between the positioning member 18 and the inner wall surface of the blind hole 134, as a damper. Thereby, the contacting distal end portion 180 can reliably abut, i.e., contact against the positioning surface portion 136*ip* located on the retarding side Dr in the circumferential direction. Therefore, the accuracy of the positioning of the inner rotor 20 at the time of limiting the rotation of the inner rotor 20 with the shoe housing 12 is improved, so that the required adjustment accuracy of the valve timing can be ensured.

Furthermore, according to the manufacturing method of the valve timing control apparatus 1, the sprocket plate 13 and the shoe housing 12 are joined together in the axial direction. Therefore, there is a possibility of positional deviation of the press fitting hole portion 125 and the tapered hole portion 136 from the normal positions thereof. However, according to the manufacturing method of the present embodiment, the positioning member 18 is first press fitted into the press fitting hole portion 125 and is then inserted into the tapered hole portion 136. Therefore, when the contacting distal end portion 180 abuts against the inner peripheral surface 136*i* of the tapered hole portion 136 on the retarding side Dr in the circumferential direction, the above-described positional deviation of the press fitting hole portion 125 and the tapered hole portion 136 from the normal positions thereof can be absorbed or alleviated. Furthermore, as discussed above, the main shaft portion 182 does not project from the press fitting hole portion 125 toward the tapered hole portion 136 side. Thus, the control of the press-in load is eased, and thereby the deformation of the sprocket plate 13 can be limited. Accordingly, the accuracy of the positioning of the inner rotor 20 at the time of stopping the rotation of the inner rotor 20 with the shoe housing 12 is ensured, and the deformation of the sprocket plate 13 is limited. As a result, the required adjustment accuracy of the valve timing can be ensured.

The embodiment of the present disclosure has been described. However, the present disclosure should not be limited to the described embodiment, and the described embodiment may be modified in various ways within the principle of the present disclosure.

Figure 7:
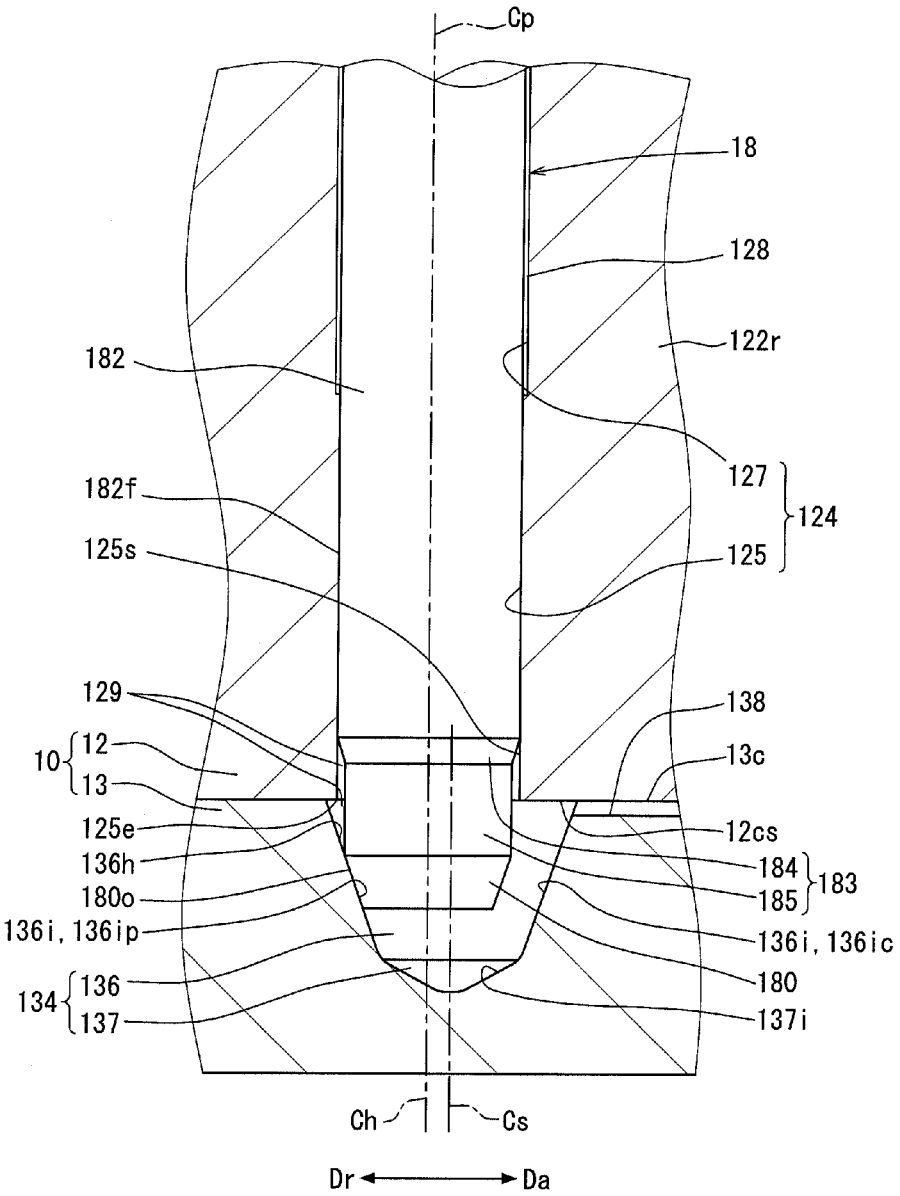
FIG. 7 is a cross sectional view showing a modification of FIG. 4.
Figure 8:
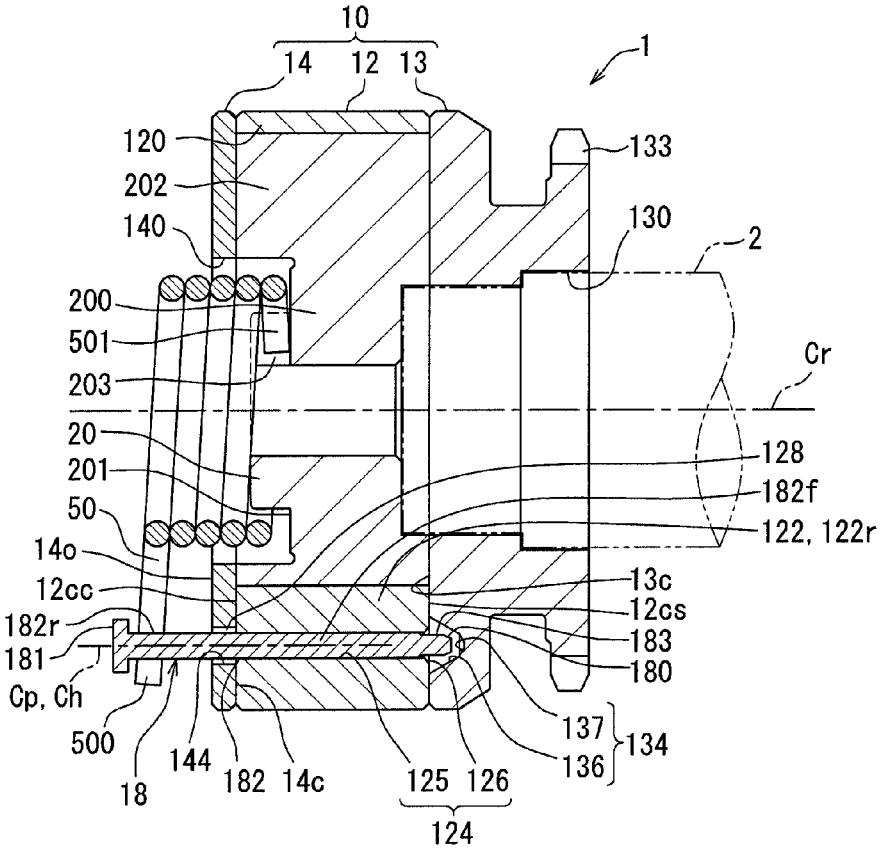
FIG. 8 is a cross sectional view showing a modification of FIG. 1.
Figure 9:
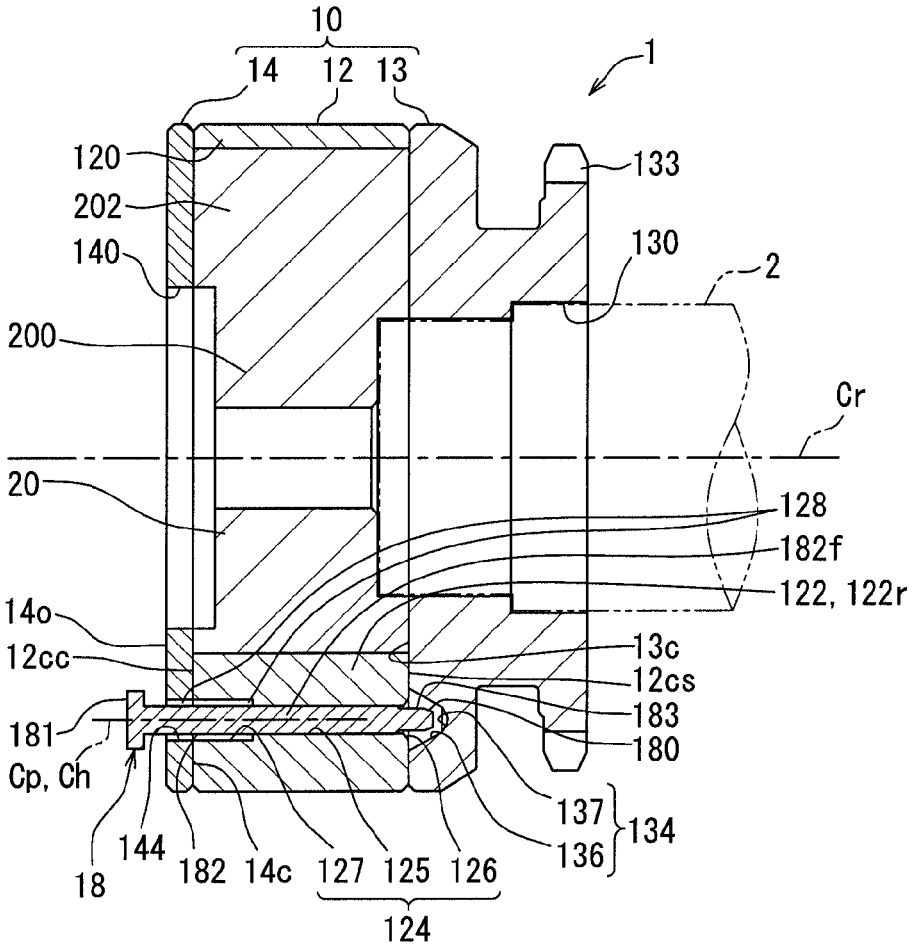
FIG. 9 is a cross sectional view showing a modification of FIG. 1.

Specifically, in a first modification, as shown in FIG. 7, the chamfered hole portion 126 of the above embodiment may be eliminated. Furthermore, in a second modification, as shown in FIG. 8, the guide hole portion 127 of the above embodiment may be eliminated. Also, in a third modification, as shown in FIG. 9, the torsion spring 50 of the above embodiment, which serves as the resilient member, may be eliminated. In the case of the third modification, step S103 of the manufacturing method of FIG. 5 is no longer required.

Figure 10:
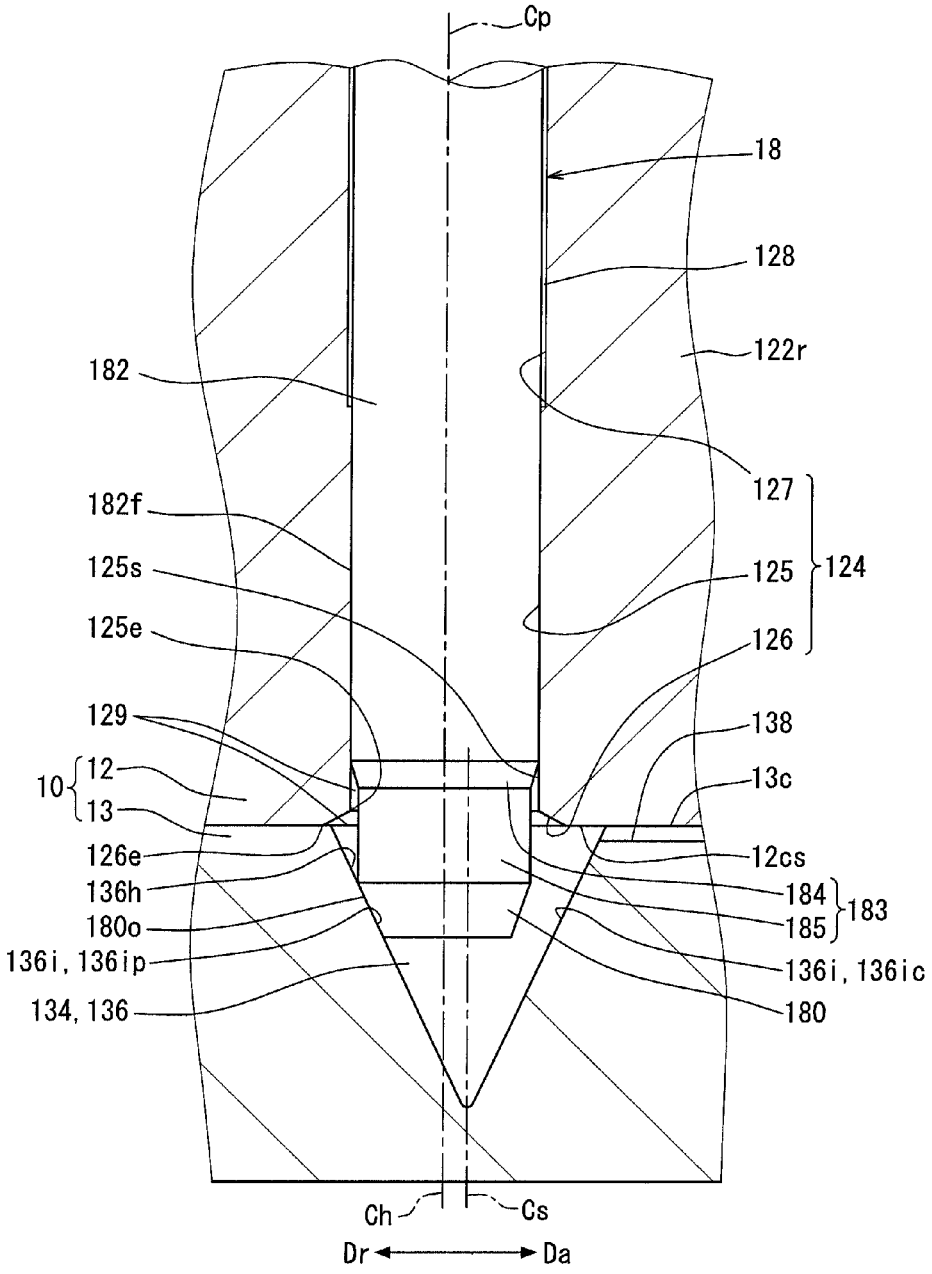
FIG. 10 is a cross sectional view showing a modification of FIG. 4.
Figure 11:
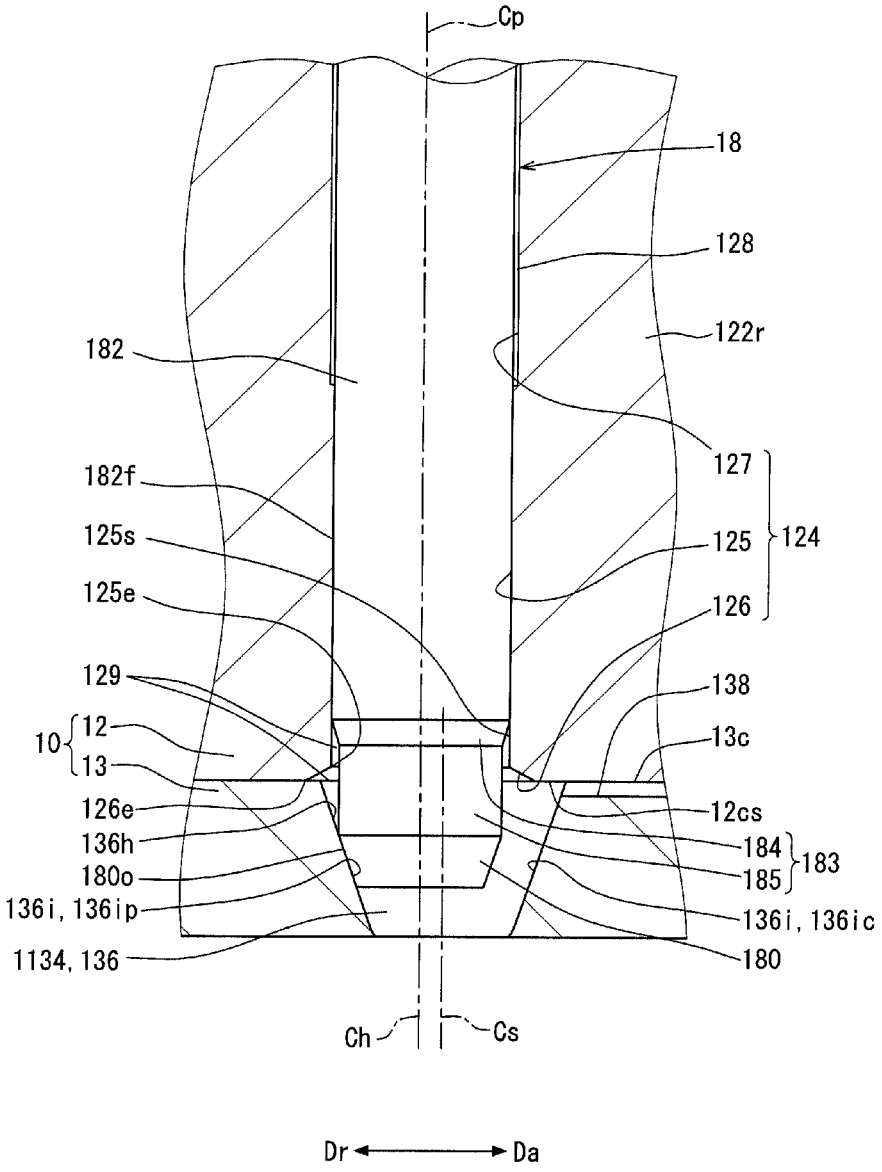
FIG. 11 is a cross sectional view showing a modification of FIG. 4.
Figure 12:
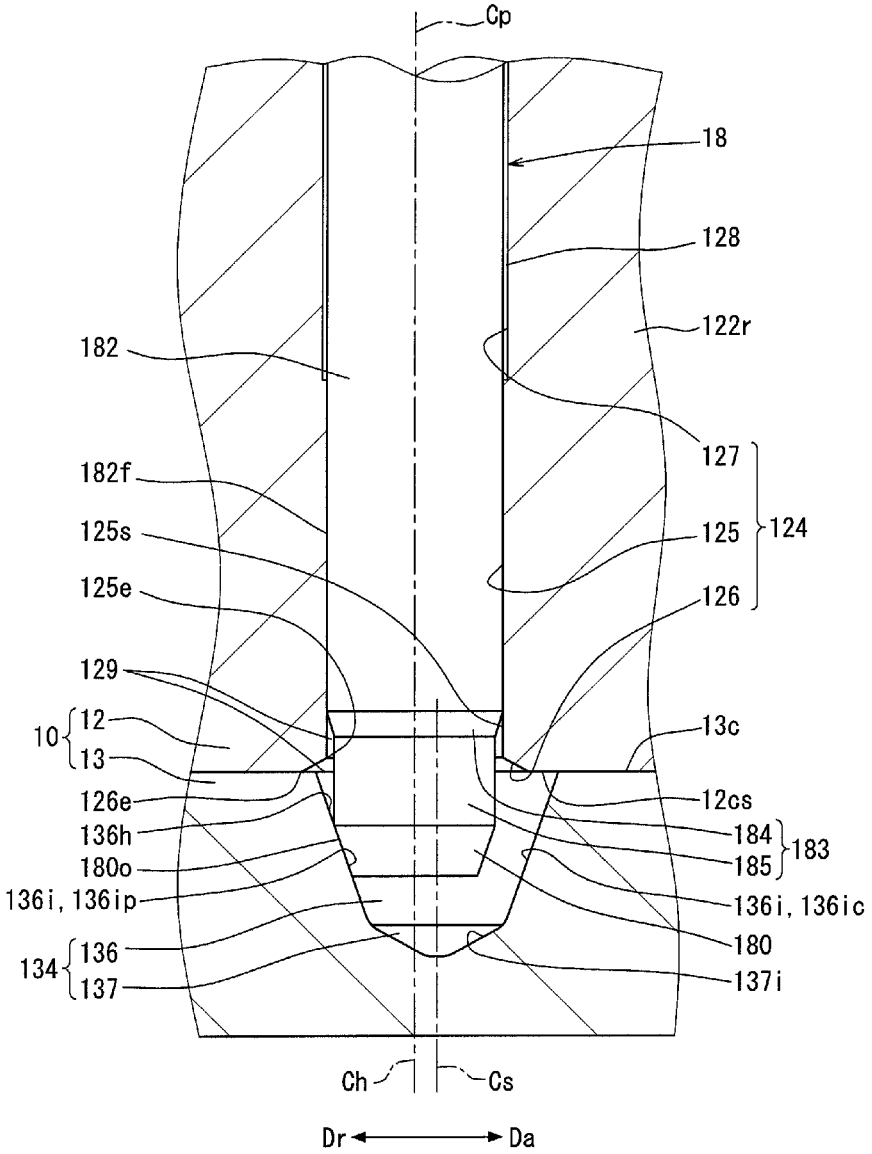
FIG. 12 is a cross sectional view showing a modification of FIG. 4.

In a fourth modification, as shown in FIG. 10, the blind hole 134 may be made of only with the tapered hole portion 136 of the above embodiment. In a fifth modification, as shown in FIG. 11, a through hole 1134, which includes the tapered hole portion 136 and opens to the atmosphere, may be formed in place of the blind hole 134 of the above embodiment. In the case of the fifth modification, as shown in FIG. 11, the through hole 1134, which is made of only with the tapered hole portion 136, may be used. Alternatively, although not depicted, the through hole 1134, which includes the tapered hole portion 136 and another hole portion, may be used. Furthermore, in a sixth modification, as shown in FIG. 12, the communication groove 138 of the above embodiment may be eliminated.

Figure 13:
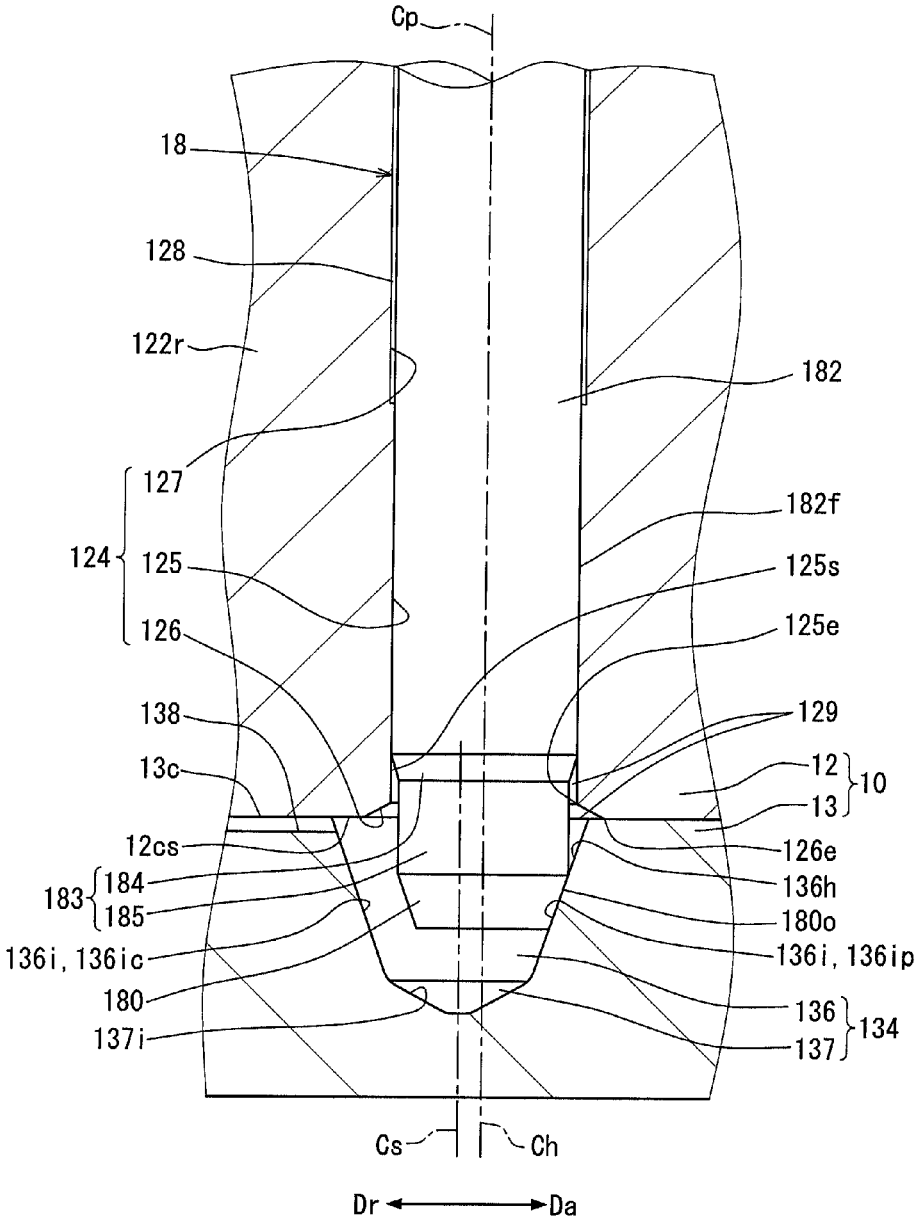
FIG. 13 is a cross sectional view showing a modification of FIG. 4.

In a seventh modification, as shown in FIG. 13, the positioning surface portion 136*ip*, against which the outer peripheral surface 180*o* of the contacting distal end portion 180 contacts on the advancing angle side Da (serving as a specific side) in the circumferential direction, may be formed in the inner peripheral surface 136*i* of the tapered hole portion 136. In an eighth modification, the taper angle of the outer peripheral surface 180*o* of the contacting distal end portion 180 may be set to be different from the taper angle of the inner peripheral surface 136*i* of the tapered hole portion 136 as long as the outer peripheral surface 180*o* of the contacting distal end portion 180 can contact the positioning surface portion 136*ip*. In a ninth modification, the outer peripheral surface 180*o* of the contacting distal end portion 180 may be formed as a cylindrical surface that extends straight in the axial direction as long as the outer peripheral surface 180*o* of the contacting distal end portion 180 can contact the positioning surface portion 136*ip*.

In a tenth modification, the receiving part 182*r* of the main shaft portion 182 may be placed on the advancing side Da of the torsion spring 50 in the circumferential direction to hold the torsion spring 50. In the case of the tenth modification, the receiving part 182*r* of the main shaft portion 182, which is located on the advancing side Da of the torsion spring 50 in the circumferential direction, receives the restoring force of the torsion spring 50, which is applied to the receiving part 182*r* in the circumferential direction toward the advancing side Da. Furthermore, in the tenth modification, the positioning surface portion 136*ip* may be formed on the retarding side Dr (serving as the specific side) like in the embodiment described above. Alternatively, in the tenth modification, the positioning surface portion 136*ip* may be formed on the advancing side Da (serving as the specific side) by combining the tenth modification with the seventh modification.

In an eleventh modification, the present disclosure may be applied to a valve timing control apparatus that adjusts valve timing of intake valves (serving as subject valves).

What is claimed is:

1. A valve timing control apparatus for adjusting valve timing of a subject valve that is opened and closed by a camshaft through transmission of a crank torque from a crankshaft at an internal combustion engine, the valve timing control apparatus comprising:

an outer rotor that is rotated synchronously with the crankshaft in a circumferential direction; and an inner rotor that is rotated synchronously with the camshaft in the circumferential direction and is rotatable relative to the outer rotor at an inside of the outer rotor, wherein:

the outer rotor includes:

a synchronously rotatable member that is rotated synchronously with the crankshaft when the synchronously rotatable member receives the crank torque from the crankshaft;

a stopper member that is rotated integrally with the synchronously rotatable member that is joined to the stopper member in an axial direction, wherein the stopper member stops rotation of the inner rotor that is rotated relative to the outer rotor in the circumferential direction; and a positioning member that is shaped into a rod form and extends in the axial direction, wherein the positioning member positions the stopper member relative to the synchronously rotatable member in the circumferential direction;

the synchronously rotatable member includes a tapered hole portion that is tapered such that an inner diameter of an inner peripheral surface of the tapered hole portion is progressively increased in the axial direction toward the stopper member;

the stopper member includes a press fitting hole portion that extends straight in the axial direction, wherein the positioning member is press fitted into the press fitting hole portion; and the positioning member includes:

a contacting distal end portion that is inserted into the tapered hole portion in the axial direction and contacts the inner peripheral surface of the tapered hole portion on a specific side, which is a circumferential side in the circumferential direction;

a main shaft portion that extends straight in the axial direction and is press fitted into the press fitting hole portion in the axial direction; and a loosely inserting shaft portion that is formed between the contacting distal end portion and the main shaft portion and is loosely inserted into the press fitting hole portion in the axial direction.

2. The valve timing control apparatus according to claim 1, wherein the stopper member includes:

a contact surface that contacts the synchronously rotatable member in the axial direction; and a chamfered hole portion that is placed between the contact surface and the press fitting hole portion and has an inner diameter, which is increased from an inner diameter of the press fitting hole portion.

3. The valve timing control apparatus according to claim 1, comprising a resilient member that urges the inner rotor relative to the outer rotor in the circumferential direction by generating a restoring force, wherein the resilient member is anchored to the positioning member, and thereby the positioning member receives the restoring force of the resilient member on the specific side in the circumferential direction.

4. The valve timing control apparatus according to claim 1, wherein an outer peripheral surface of the contacting distal end portion, which contacts the inner peripheral surface of the tapered hole portion on the specific side in the circumferential direction, is tapered such that an outer diameter of the outer peripheral surface of the contacting distal end portion is progressively increased in the axial direction toward the stopper member along the inner peripheral surface of the tapered hole portion.

5. The valve timing control apparatus according to claim 1, wherein the synchronously rotatable member has a blind hole that includes the tapered hole portion and is communicatable with an atmosphere.

6. The valve timing control apparatus according to claim 1, wherein:

an outer diameter of the main shaft portion is constant along an entire extent of the main shaft portion; and the loosely inserting shaft portion, which is loosely inserted into the press fitting hole portion, has an outer diameter that is smaller than the outer diameter of the main shaft portion.

7. A manufacturing method of the valve timing control apparatus according claim 1, comprising:

a connecting step of connecting the synchronously rotatable member and the stopper member together in the axial direction; and a positioning step of press fitting the positioning member into the press fitting hole portion of the stopper member and further inserting the positioning member into the tapered hole portion, so that the stopper member is positioned in the circumferential direction relative to the synchronously rotatable member after the synchronously rotatable member and the stopper member are connected together in the connecting step.

8. A valve timing control apparatus for adjusting valve timing of a subject valve that is opened and closed by a camshaft through transmission of a crank torque from a crankshaft at an internal combustion engine, the valve timing control apparatus comprising:

an outer rotor that is rotated synchronously with the crankshaft in a circumferential direction; and an inner rotor that is rotated synchronously with the camshaft in the circumferential direction and is rotatable relative to the outer rotor at an inside of the outer rotor, wherein:

the outer rotor includes:

a synchronously rotatable plate that is rotated synchronously with the crankshaft when the synchronously rotatable plate receives the crank torque from the crankshaft;

a stopper that is rotated integrally with the synchronously rotatable plate that is joined to the stopper in an axial direction, wherein the stopper stops rotation of the inner rotor that is rotated relative to the outer rotor in the circumferential direction; and a positioning member that is shaped into a rod form and extends in the axial direction, wherein the positioning member positions the stopper relative to the synchronously rotatable plate in the circumferential direction;

the synchronously rotatable plate includes a tapered hole portion that is tapered such that an inner diameter of an inner peripheral surface of the tapered hole portion is progressively increased in the axial direction toward the stopper;

the stopper includes a press fitting hole portion that extends straight in the axial direction, wherein the positioning member is press fitted into the press fitting hole portion; and the positioning member includes:

a contacting distal end portion that is inserted into the tapered hole portion in the axial direction and contacts the inner peripheral surface of the tapered hole portion on a specific side, which is a circumferential side in the circumferential direction;

a main shaft portion that extends straight in the axial direction and is press fitted into the press fitting hole portion in the axial direction; and a loosely inserting shaft portion that is formed between the contacting distal end portion and the main shall portion and is loosely inserted into the press fitting hole portion in the axial direction.

9. The valve timing control apparatus according to claim 8, wherein the stopper includes:

a contact surface that contacts the synchronously rotatable plate in the axial direction; and a chamfered hole portion that is placed between the contact surface and the press fitting hole portion and has an inner diameter, which is increased from an inner diameter of the press fitting hole portion.

10. The valve timing control apparatus according to claim 8, comprising a spring that urges the inner rotor relative to the outer rotor in the circumferential direction by generating a restoring force, wherein the spring is anchored to the positioning member, and thereby the positioning member receives the restoring force of the spring on the specific side in the circumferential direction.

11. The valve timing control apparatus according to claim 8, wherein an outer peripheral surface of the contacting distal end portion, which contacts the inner peripheral surface of the tapered hole portion on the specific side in the circumferential direction, is tapered such that an outer diameter of the outer peripheral surface of the contacting distal end portion is progressively increased in the axial direction toward the stopper along the inner peripheral surface of the tapered hole portion.

12. The valve timing control apparatus according to claim 8, wherein the synchronously rotatable plate has a blind hole that includes the tapered hole portion and is communicatable with an atmosphere.

13. The valve timing control apparatus according to claim 8, wherein:

an outer diameter of the main shaft portion is constant along an entire extent of the main shaft portion; and the loosely inserting shaft portion, which is loosely inserted into the press fitting hole portion, has an outer diameter that is smaller than the outer diameter of the main shaft portion.

14. A manufacturing method of the valve timing control apparatus according claim 8, comprising:

a connecting step of connecting the synchronously rotatable plate and the stopper together in the axial direction; and a positioning step of press fitting the positioning member into the press fitting hole portion of the stopper and further inserting the positioning member into the tapered hole portion, so that the stopper is positioned in the circumferential direction relative to the synchronously rotatable plate after the synchronously rotatable plate and the stopper are connected together in the connecting step.

* * * * *